US006880903B2

(12) United States Patent
O'Halloran et al.

(10) Patent No.: US 6,880,903 B2
(45) Date of Patent: Apr. 19, 2005

(54) LOCKING DIVIDER FOR A REFRIGERATOR STORAGE COMPARTMENT

(75) Inventors: Jeffrey O'Halloran, Cedar Rapids, IA (US); Eric Silbaugh, Cedar Rapids, IA (US); Xiaojian James Chen, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,609

(22) Filed: Mar. 12, 2003

(65) Prior Publication Data

US 2004/0178708 A1 Sep. 16, 2004

(51) Int. Cl.[7] ..... A47B 96/04
(52) U.S. Cl. ..... 312/407; 312/348.3; 211/184
(58) Field of Search ..... 312/348.1, 348.2, 312/348.3, 330.1, 321, 401, 408, 407; 211/184, 43, 11; 108/60, 61; 160/135; 220/592.05

(56) References Cited

U.S. PATENT DOCUMENTS

| | | | | | |
|---|---|---|---|---|---|
| 446,480 | A | * | 2/1891 | Stebbins | 160/81 |
| 1,532,769 | A | * | 4/1925 | McElroy | 160/137 |
| 1,793,036 | A | * | 2/1931 | Whitney | 211/123 |
| 1,876,494 | A | * | 9/1932 | Furo | 211/153 |
| 2,247,024 | A | * | 6/1941 | Hurley | 52/632 |
| 2,910,188 | A | * | 10/1959 | Skolfield et al. | 211/184 |
| 3,145,850 | A | * | 8/1964 | Ciborowski | 211/133.5 |
| 3,892,378 | A | * | 7/1975 | Lane | 248/71 |
| 3,893,739 | A | | 7/1975 | Bernard | |
| 4,788,832 | A | * | 12/1988 | Aoki et al. | 62/382 |
| 5,221,013 | A | * | 6/1993 | Santucci | 211/153 |
| 5,486,046 | A | * | 1/1996 | Jernstrom et al. | 312/408 |
| 5,765,390 | A | | 6/1998 | Johnson et al. | |
| 6,640,509 | B1 | * | 11/2003 | Clewis | 52/202 |

FOREIGN PATENT DOCUMENTS

| | | |
|---|---|---|
| FR | 2719753 | 11/1995 |

* cited by examiner

*Primary Examiner*—Peter M. Cuomo
*Assistant Examiner*—Stephen D'Adamo
(74) *Attorney, Agent, or Firm*—Diederiks & Whitelaw, PLC

(57) ABSTRACT

A divider for a pan, drawer or the like compartment in a refrigerator is constituted by multiple, pivotally interconnected pieces which can be selectively locked in a desired position to compartmentalize the storage compartment. The divider defines an over-center device that can be snapped into a locked in a desired position in the compartment, while being locked in position as a result of compressive forces being applied by front and rear walls of the pan or drawer. That is, the pan or drawer is preferably made of plastic and includes walls which deflect upon locking the divider in place. When the divider is opened or unlatched, all compressive forces are removed and the divider can be easily adjusted within the pan or drawer.

22 Claims, 4 Drawing Sheets

LOCKING DIVIDER FOR A REFRIGERATOR STORAGE COMPARTMENT

BACKGROUND OF THE INVENTION

1. Field of the Invention

The present invention pertains to the art of refrigerators and, more particularly, to a divider used to selectively separate a storage compartment in a refrigerator.

2. Discussion of the Prior Art

In the art of refrigerators, it is widely known to employ a plurality of shelves and compartments, including drawers and pans, to store a wide range of food products. For instance, in a fresh food compartment, shelves, drawers, pans, removable bins and the like are commonly found both in the body of the compartment and on the inside of the door for storing food items. When storing the food items, it is generally undesirable to enable excessive shifting. This is particularly true in connection with door supported food items in order to prevent the food items from falling when the door is abruptly opened or closed. To address this concern, it is known to employ retainers in connection with door supported shelves, bins, dairy compartments and the like to divide the storage zones, while limiting the potential shifting of the food items.

While retainers of this kind have been advantageously employed in connection with shelves and other storage zones on refrigerator doors, little has been done in effectively providing dividers for use in connection with refrigerator drawers, pans and the like. That is, a typical slidable drawer or pan in a refrigerator defines a single compartment for the storage of food items which are generally laid on top of one another or simply allowed to shift throughout the compartment over time. Obviously, such an arrangement does not represent an efficient and effective overall storage configuration. Although the storage compartment could be molded or otherwise formed with a divider in order to establish multiple storage zones, it would be desirable to have an adjustable divider which could be used to selectively section off any part of a refrigerator drawer, pan or the like compartment for improved organizational purposes.

SUMMARY OF THE INVENTION

The present invention is directed to a divider for a pan, drawer or the like storage compartment in a refrigerator wherein the divider constitutes multiple, pivotally interconnected pieces which can be selectively locked in any one of an essentially infinite number of positions to compartmentalize a storage zone. In accordance with the most preferred form of the invention, the divider defines an over-center device that can be arranged in a desired position in the storage compartment, while being locked in position as a result of compressive forces being applied by front and rear walls of the pan or drawer. That is, the pan or drawer is preferably made of plastic and includes walls which deflect upon locking the divider in place. When the divider is opened or unlatched, all compressive forces are removed and the divider can be easily adjusted to essentially an infinite number of positions within the pan or drawer.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
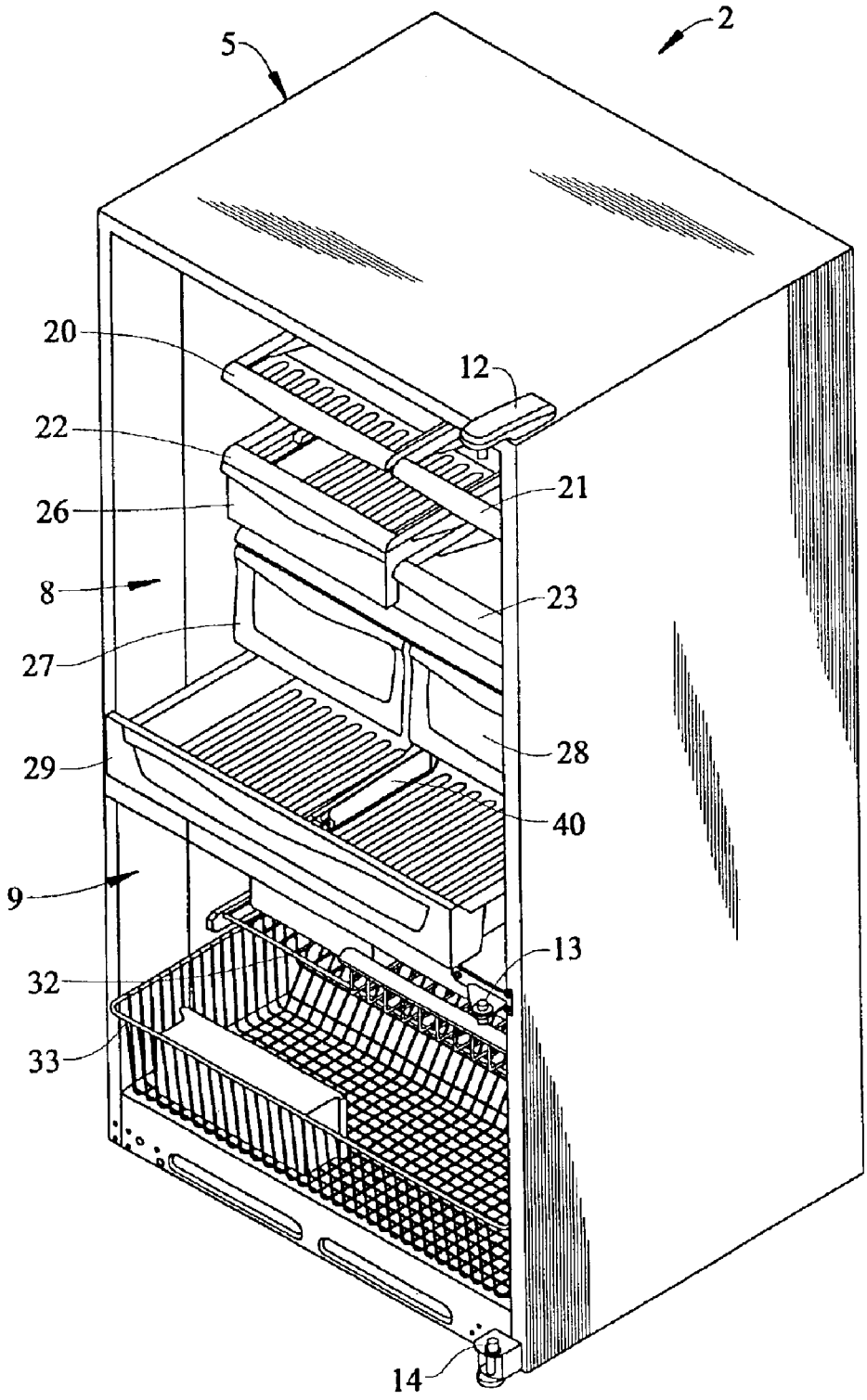
FIG. 1 is a perspective view of a refrigerator provided with the divider of the invention.

With initial reference to FIG. 1, a refrigerator associated with the present invention is generally indicated at 2. As shown, refrigerator 2 includes a cabinet 5 within which is defined an upper fresh food compartment 8 and a lower freezer compartment 9. Also depicted are upper, central and lower hinges 12–14 which are used in connection with pivotally mounting fresh food and freezer doors of refrigerator 2, with the fresh food and freezer doors not being shown in order to illustrate internal components of refrigerator 2. At this point, it should be realized that, although refrigerator 2 is shown to constitute a bottom mount style refrigerator, the invention is equally applicable to other refrigerator styles, including top mount and side-by-side units.

In the embodiment shown, fresh food compartment 8 includes a plurality of spaced shelves 20–23, as well as a plurality of storage drawers 26–29. Storage drawer 29 actually constitutes a crisper drawer which extends across substantially the entire width of fresh food compartment 8. On the other hand, freezer compartment 9 is shown to include upper and lower racks 32 and 33 for storing food items to be frozen. In any case, the present invention is particularly directed to the inclusion of one or more compartment dividers 40 for fresh food compartment 8 and/or freezer compartment 9 of refrigerator 2. In the preferred embodiment shown, one divider 40 is shown arranged in storage drawer 29.

Figure 2:
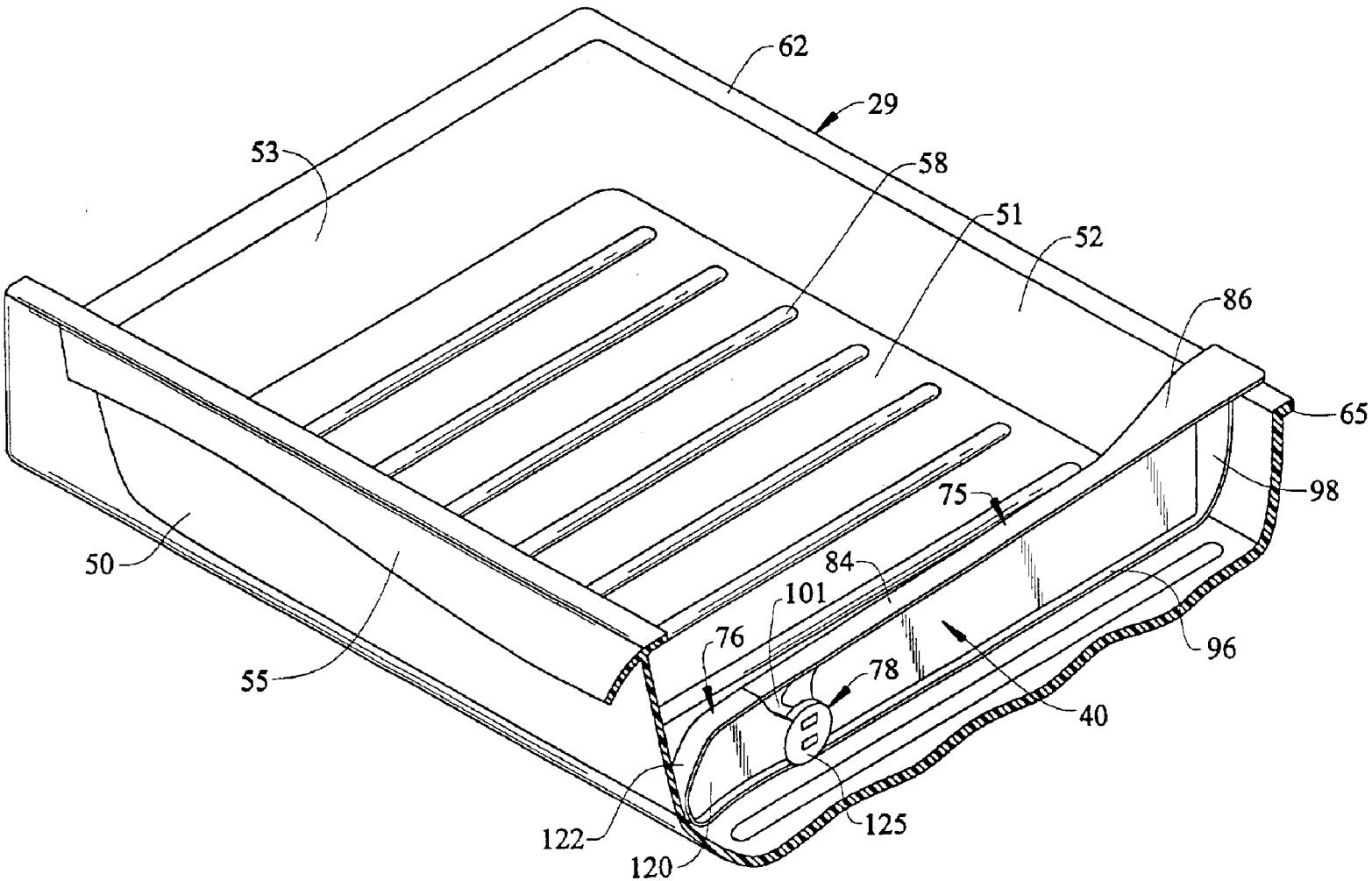
FIG. 2 is an enlarged perspective, sectional view of a storage compartment shown in FIG. 1 incorporating the divider of the invention.

In general, as best shown in FIG. 2, storage drawer 29 is molded of plastic to include a front wall 50, a bottom wall 51, a rear wall 52 and a pair of opposing side walls 53. Front wall 50 includes a handle 55 which can be selectively grasped to slide storage drawer 29 between an access position shown in FIG. 1 and a recessed position. Bottom wall 51 of storage drawer 29 is also preferably formed with a plurality of fore-to-aft extending and laterally spaced, raised ribs 58 upon which food items can be supported. In addition, rear wall 52 has an upper portion 62 which leads to a rearwardly extending flange 65 (also see FIGS. 4 and 5).

Figure 3:
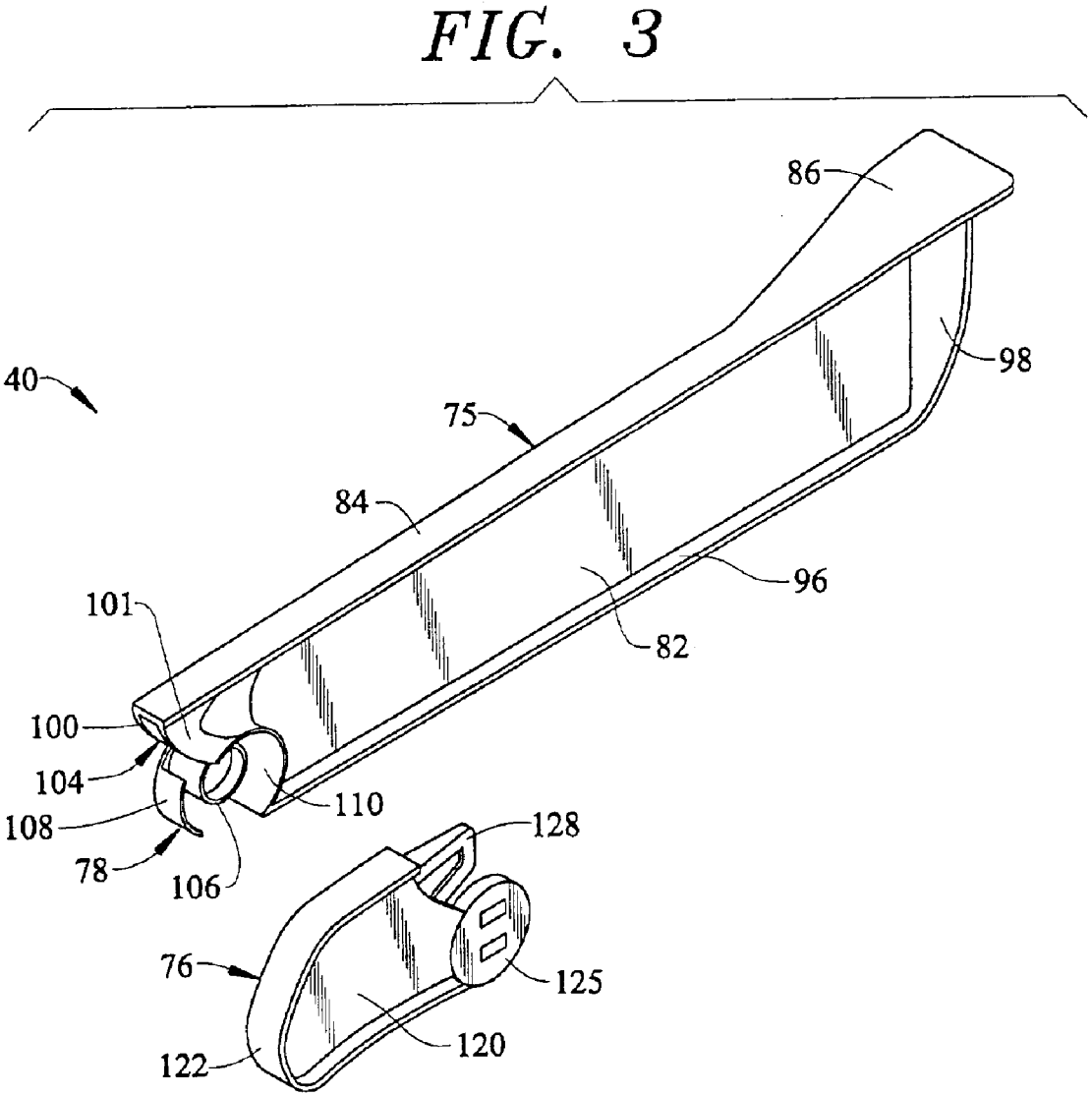
FIG. 3 is an exploded view of the divider of FIG. 2.

Reference will now be made to FIGS. 2 and 3 is describing the construction of divider 40 in accordance with the most preferred embodiment of the invention. In general, divider 40 is preferably integrally molded of plastic. Specifically, divider 40 is molded of two main pieces 75 and 76 which are pivotally interconnected at a connector joint 78. Main piece 75 includes a main body 82 which has associated therewith an upper ledge 84. Upper ledge 84 preferably has a flared rear section 86 which terminates in a central hook element 90 (see FIGS. 4 and 5). Main body 82 also includes a lower ledge 96 leading to a rear flange 98 that connects to flared rear section 86. At a front of main piece 75, connector joint 78 includes a pair of spaced guide walls 100 and 101 which defines a groove 104 there between. Connector joint 78 is also formed with a laterally extending spacer sleeve 106, a front arcuate wall 108 and a rear arcuate wall 110.

On the other hand, piece 76 of divider 40 includes a body portion 120 about a substantial percentage of which extends an outer ledge portion 122. At one rear side of connector piece 76 is formed a disk element 125, while a tongue member 128 projects from a central rear zone of piece 76. With this construction, pieces 75 and 76 of divider 40 are interconnected for relative pivotal movement with tongue 128 projecting into groove 104 and disk element 125 being positioned against spacer sleeve 106, within the confines of front and rear arcuate walls 108 and 110. Preferably, pieces 75 and 76 are permitted to pivot relative to each other through no more than ninety degrees and, more preferably, to not substantially greater than forty-five degrees. If desired, additional structure could be provided, such as interrelated stops and channels in spacer sleeve 106 and disk element 125, to further limit the pivoting of piece 76 relative to piece 75.

Figure 4:
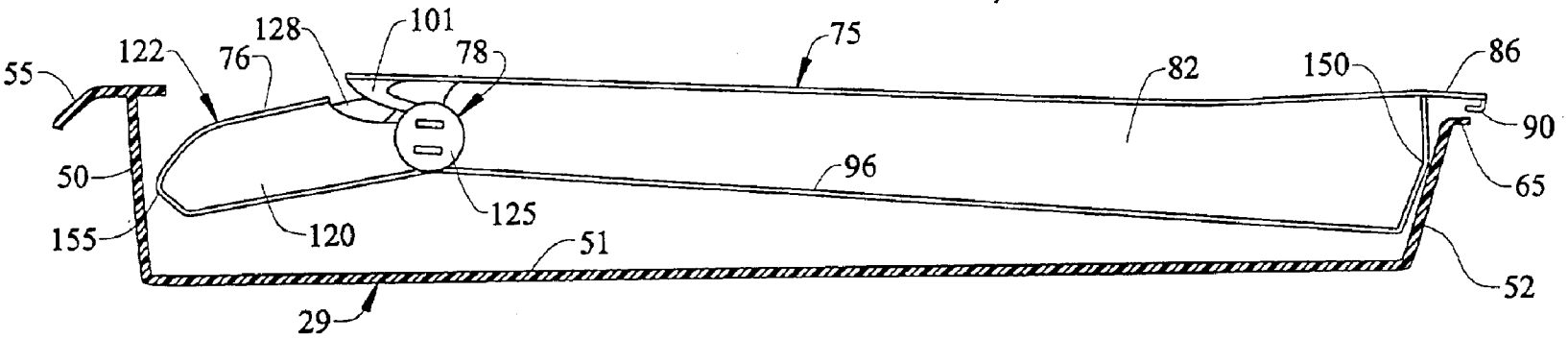
FIG. 4 is a side view of the divider of FIG. 2 in an initial mounting position.
Figure 5:
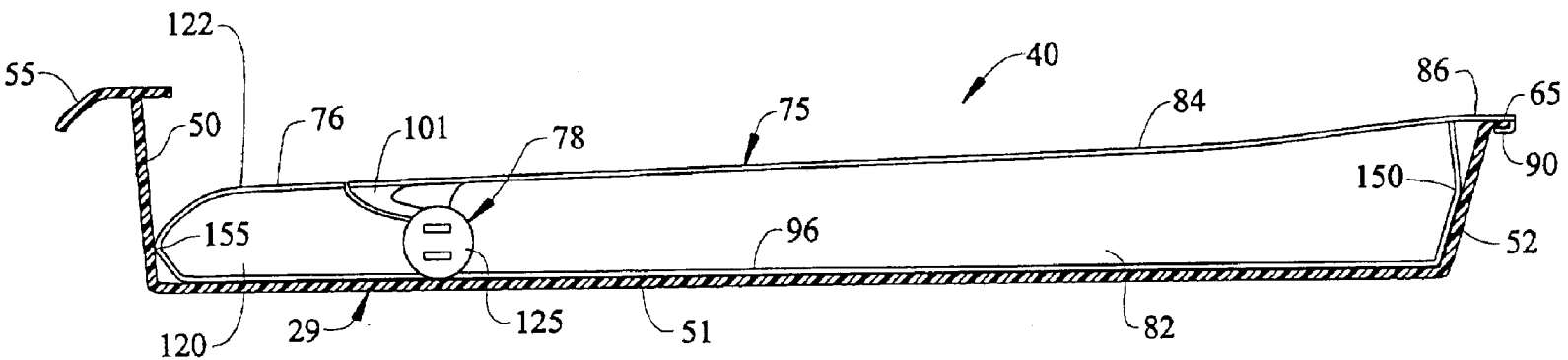
FIG. 5 is a side view of the divider, similar to that of FIG. 4, shown in a locked position.

With particular reference to FIGS. 2, 4 and 5, the manner in which divider 40 is employed to compartmentalize storage drawer 29 in accordance with the invention will now be described in detail. In general, divider 40 can be positioned in any desired position laterally between side walls 53 of storage drawer 29. In this sense, there exists an infinite number of positions between the two extremes defined by side walls 53. With initial reference to FIG. 4, divider 40 is first angled in order to place hook element 90 about rearwardly extending flange 65. To aid in this mounting, a vertex section 150 at a rear of piece 75 abuts rear wall 52 in order to act as a fulcrum. At this point, pieces 75 and 76 are not aligned, but rather assume the position generally illustrated in FIG. 4. Thereafter, an apex section 155 of piece 76 will abut front wall 50. Still, divider 40 is slightly angled. However, pushing down on upper ledge 84 above connector joint 78 will, in fact, lengthen divider 40.

Given the overall length of divider 40 and the distance between front and rear walls 50 and 52, the straightening of divider 40 will cause storage drawer 29 to deflect in order to exert a compressive force on divider 40. At the same time, connector joint 78 actually establishes an over-center acting hinge. This combination functions to snap-lock divider 40 in place, thereby establishing multiple compartments within storage drawer 29. Of course, divider 40 can be opened or unlatched, whereupon all compressive forces are removed and divider 40 can be easily adjusted within storage drawer 29 for optimizing the organization of stored food items within storage drawer 29.

Although described with reference to a preferred embodiment of the invention, it should be readily understood that various changes and/or modifications can be made to the invention without departing from the spirit thereof. For instance, although divider 40 is disclosed in connection with storage drawer 29 which extends across substantially the entire width of fresh food compartment 8, divider 40 could also be employed in connection with smaller drawers and the like. In general, the invention is only intended to be limited by the scope of the following claims.

We claim:

1. A refrigerator comprising:

a cabinet within which is defined a fresh food compartment and a freezer compartment;

a plurality of shelves arranged in the fresh food compartment;

a storage drawer provided in the fresh food compartment, said storage drawer including front, bottom, rear and side walls; and a divider including first and second pivotally interconnected pieces, said divider extending between and against the front and rear walls of the storage drawer, while being locked in position through relative pivoting of the first and second pieces, in order to divide the storage drawer into multiple storage zones, wherein the first piece is provided with a vertex section which abuts rear wall and acts as a fulcrum in mounting of said divider.

2. The refrigerator according to claim 1, wherein the second piece of said divider is provided with an apex section which abuts the front wall of the storage drawer in mounting of said divider.

3. The refrigerator according to claim 1, wherein at least one of the front and rear walls of the storage drawer applies a compressive force tending to maintain the divider locked in position.

4. The refrigerator according to claim 1, wherein the first and second pieces of the divider are pivotally interconnected through a connector joint, said connector joint including a groove defined by the first piece and a tongue element extending from the second piece, wherein the tongue element projects into the groove.

5. The refrigerator according to claim 1, wherein the first and second pieces are locked in position through an over-center pivoting action.

6. The refrigerator according to claim 1, wherein the relative pivoting of the first and second pieces is limited to not substantially greater than forty-five degrees.

7. The refrigerator according to claim 1, wherein the divider is attached to one of the front and rear walls of the storage drawer.

8. The refrigerator according to claim 7, wherein the rear wall of the storage drawer includes an upper rear flange, said divider being connected to the upper rear flange.

9. The refrigerator according to claim 8, wherein the first piece of the divider is provided with a hook element which extends about the upper rear flange of the rear wall.

10. A refrigerator comprising:

a cabinet within which is defined a fresh food compartment and a freezer compartment;

a plurality of shelves arranged in the fresh food compartment;

a storage drawer provided in the fresh food compartment, said storage drawer including front, bottom, rear and side walls; and a divider including first and second pivotally interconnected pieces, said divider extending between and against the front and rear walls of the storage drawer, while being locked in position through relative pivoting of the first and second pieces, in order to divide the storage drawer into multiple storage zones, wherein the first and second pieces of the divider are pivotally interconnected through a connector joint, said connector joint including a first arcuate wall and a disk element positioned within the first arcuate wall.

11. The refrigerator according to claim 10, wherein said connector joint includes a second arcuate wall, separate and distinct from the first arcuate wall, said disk element being positioned between the first and second arcuate walls.

12. A divider for use in separating a storage drawer in a refrigerator into multiple storage zones comprising:

a first piece provided with a vertex section; and a second piece pivotally interconnected with the first piece, said divider being adapted to extend between and against front and rear walls of a refrigerator storage drawer and to be locked in position upon relative pivoting of the first and second pieces, with the vertex section being adapted to act as a fulcrum in mounting of the divider, in order to divide the storage drawer into multiple storage zones.

13. The divider according to claim 12, wherein the first piece of the divider is provided with a hook element.

14. The divider according to claim 12, wherein the second piece of said divider is provided with an apex section.

15. The divider according to claim 12, wherein the first and second pieces of the divider are pivotally interconnected through a connector joint, said connector joint including a groove defined by the first piece and a tongue element extending from the second piece, wherein the tongue element projects into the groove.

16. The divider according to claim 12, wherein the first and second pieces are locked in position through an over-center pivoting action.

17. The divider according to claim 12, wherein the relative pivoting of the first and second pieces is limited to not substantially greater than forty-five degrees.

18. A divider for use in separating a storage drawer in a refrigerator into multiple storage zones comprising:

a first piece; and a second piece pivotally interconnected with the first piece, said divider being adapted to extend between and against front and rear walls of a refrigerator storage drawer and to be locked in position upon relative pivoting of the first and second pieces in order to divide the storage drawer into multiple storage zones, wherein the first and second pieces of the divider are pivotally interconnected through a connector joint, said connector joint including a first arcuate wall and a disk element positioned within the first arcuate wall.

19. The divider according to claim 18, wherein said connector joint includes a second arcuate wall, separate and distinct from the first arcuate wall, said disk element being positioned between the first and second arcuate walls.

20. A method of dividing a storage drawer provided in a fresh food compartment of a refrigerator into multiple storage zones comprising:

positioning a divider including first and second pivotally interconnected pieces between front and rear walls of the storage drawer;

positioning a vertex section of the first piece to abut the rear wall of the storage drawer;

pivoting the first and second pieces of the divider relative to each other, while utilizing the vertex section as a fulcrum in mounting of said divider; and locking the divider within the storage drawer through an over-center pivoting action in order to divide the storage drawer into multiple storage zones.

21. The method of claim 20, further comprising: initially hooking the first piece of the divider to the storage drawer upon positioning the divider between the front and rear walls.

22. The method of claim 20, further comprising: applying a compressive force on the divider by the storage drawer to maintain the divider locked in position.

* * * * *